US005669518A

United States Patent [19]

Kundel

[11] Patent Number: 5,669,518

[45] Date of Patent: Sep. 23, 1997

[54] MODULAR LIFT RAIL SYSTEM

[76] Inventor: Robert Kundel, P.O. Box 4210, Warren, Ohio 44482

[21] Appl. No.: 607,161

[22] Filed: Feb. 26, 1996

[51] Int. Cl.[6] ..... B66C 5/04

[52] U.S. Cl. ..... 212/315; 104/94; 212/314

[58] Field of Search ..... 212/74, 314, 315; 104/94

[56] References Cited

U.S. PATENT DOCUMENTS

| | | | |
|---|---|---|---|
| 1,231,462 | 6/1917 | Tutwiler . | |
| 1,752,026 | 3/1930 | Phillips . | |
| 1,858,183 | 5/1932 | Bridges . | |
| 2,099,078 | 11/1937 | Romine | 212/74 |
| 2,177,525 | 10/1939 | Henderson . | |
| 2,704,037 | 3/1955 | Babcock et al. | 212/315 |
| 3,109,385 | 11/1963 | Wilson | 104/94 |
| 3,855,937 | 12/1974 | Caudill | 104/94 |
| 3,974,777 | 8/1976 | Monne | 104/94 |
| 3,987,877 | 10/1976 | Balanchuk | 104/94 |

FOREIGN PATENT DOCUMENTS

| | | | |
|---|---|---|---|
| 3186595 | 8/1991 | Japan | 212/315 |
| 1175669 | 12/1969 | United Kingdom | 212/314 |

*Primary Examiner*—Thomas J. Brahan
*Attorney, Agent, or Firm*—Harpman & Harpman

[57] ABSTRACT

A lift rail system for industrial use combining modular universal rail units that are secured to one another to required length suspended from fully adjustable rail support posts that can be easily moved to needed locations. The rail units are formed from identical rail sections secured together in face to face relation by multiple fasteners forming both guide rails and interconnecting lift beam therebetween.

6 Claims, 5 Drawing Sheets

MODULAR LIFT RAIL SYSTEM

BACKGROUND OF THE INVENTION

1. Technical Field

This device relates to overhead cranes and the like that utilize guide tracks or rails to support a movable support bridge therebetween from which a lifting winch type assembly is supported.

2. Description of Prior Art

Prior art devices of this type have utilized a variety of different rail and guide track assemblies which use self-supporting structures on fixed posts and others that suspend from interior roof structures.

It has heretofore been difficult to easily move or reconfigure overhead cranes of this type due to the installation and support structure they require. Other limitations of existing lifting devices are directed towards their support trolleys from which the lift beam is suspended heretofore encountering twisting leverage on the lift beam between the support trolleys by uneven advancement within the guide rails causing binding of the trolleys wheels within the tracks.

In U.S. Pat. No. 1,752,026 a swivel fitting between the trolley and the lift beam is disclosed, however, uneven advance of the trolleys will still cause staggered advancement of the lift beam.

Other patents that disclose overhead lifting structures with adjustable items can be seen in U.S. Pat. Nos. 1,858,183, 1,231,426 and 2,177,525.

In U.S. Pat. No. 1,231,426 a coal unloading device can be seen having a triangular frame configuration which is supported by attachment to a rail car and support jacks. A support rail extends between the triangular frame providing an overhead lift attachment point for an unloading bucket.

U.S. Pat. No. 1,858,183 discloses a stacking operation having a mobile support frame with parallel track rails extending therefrom. Wheeled carriages transverse the rails support and lift attachment point I-beam therebetween.

U.S. Pat. No. 2,177,525 is directed to a material handling apparatus secured to a truck bed that extends for selective adjustable ground engagement. A chain hoist extends from a trolley to a beam movably suspended from the guide tracks therebetween.

SUMMARY OF THE INVENTION

A modular lift rail system provides for a free standing open ended lifting and transportation system formed of universal rail sections that are fastened together to form rail units that are combined to define rail lengths. A cross lift beam and support trolleys are movably positioned within respective rails with anti-wedging means to assure ease of lift beam travel supported therefrom. Fully adjustable rail support posts can be easily moved to alternate locations and different spacing allowing the rails depending on lift capability and location required.

DESCRIPTION OF THE PREFERRED EMBODIMENT

Figure 1:
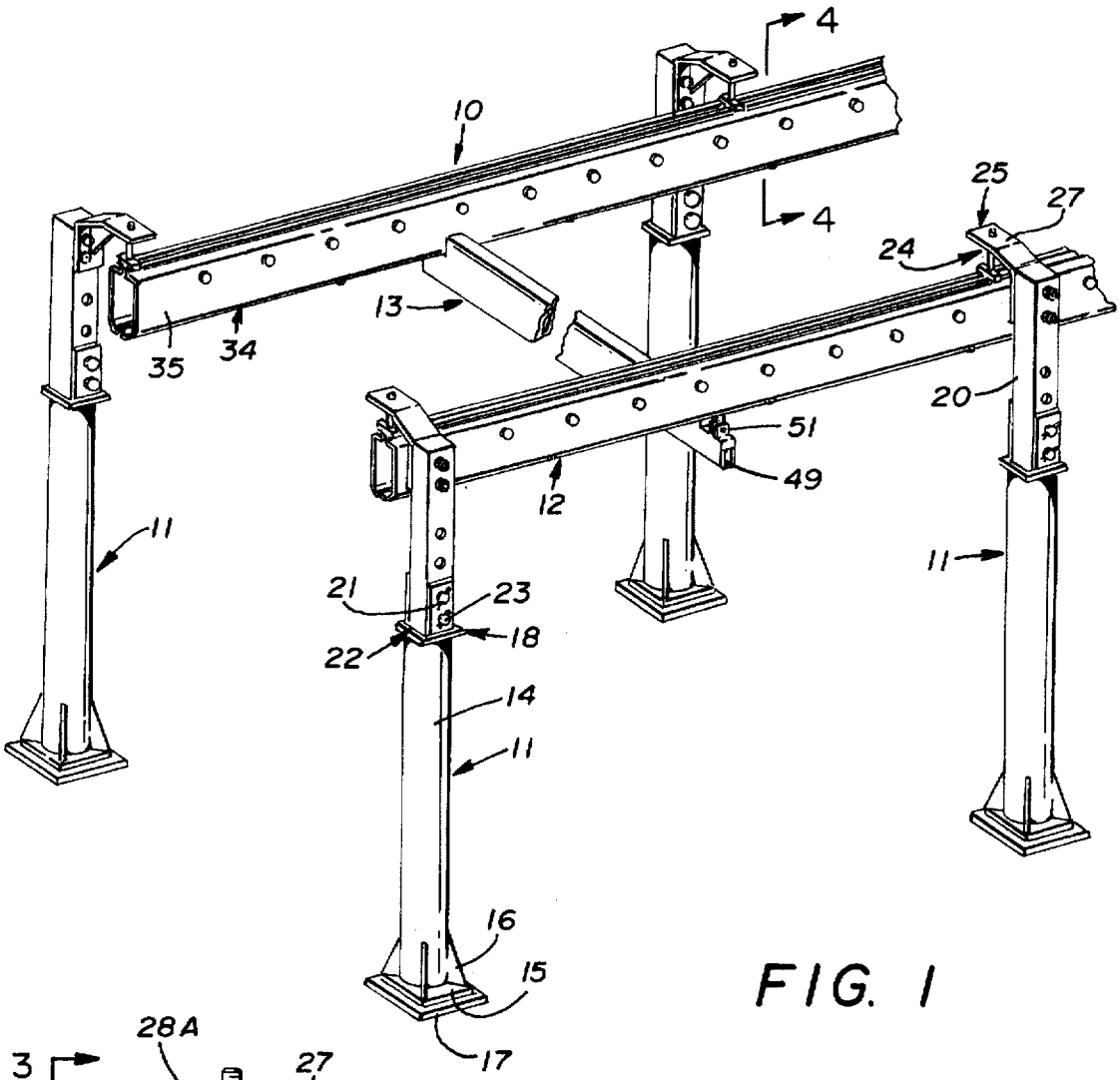
FIG. 1 is a perspective view of a lift rail assembly of the invention.

Referring to FIG. 1 of the drawings, a modular lift rail system 10 can be seen having a plurality of vertical support posts 11, a pair of parallel modular guide and support rails 12 suspended therefrom and a lift beam 13 suspended between the respective guide and support rails 12.

Figure 13:
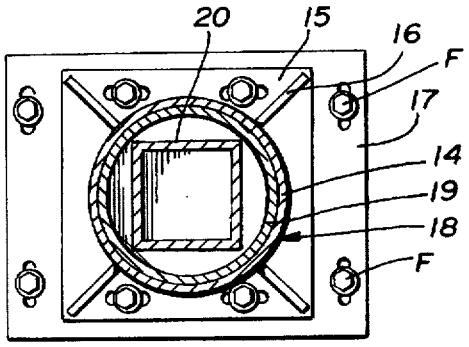
FIG. 13 is an enlarged cross-sectional view of the support posts on lines 13—13 of FIG. 12.
Figure 12:
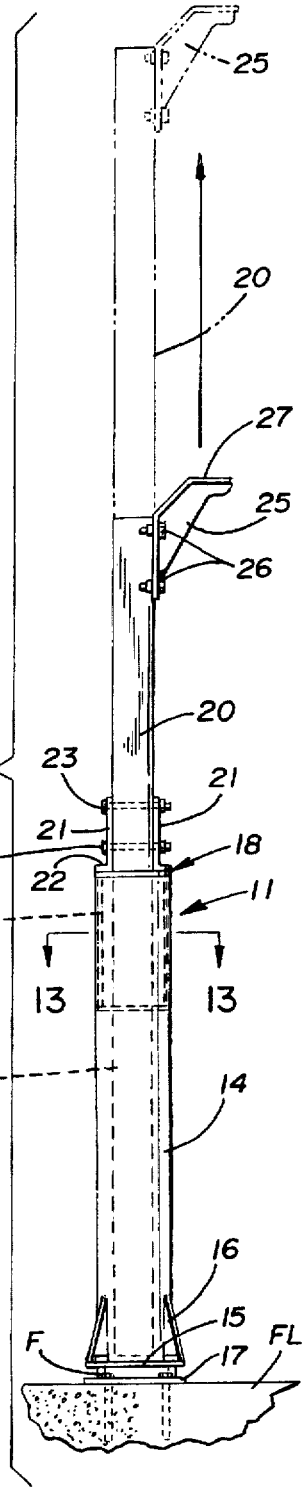
FIG. 12 is a side elevational view of an adjustable support posts with vertical range of adjustment shown in broken lines.

Referring to FIGS. 1, 12, and 13 of the drawings, each of the support posts 11 have a cylindrical portion 14 secured to a base plate 15 with support gusset 16 thereon. The base plate 15 is apertured around its perimeter edge for attachment to a floor engagement plate 17, best seen in FIGS. 12 and 13 of the drawings by a plurality of fasteners F therebetween. A transition fitting 18 is positioned within the open end of the cylindrical portion 14 having a cylindrical insert portion 19 with movably positioned cross-sectionally tubular support posts 20 extending therefrom. Oppositely disposed flanges 21 extend from a flange base 22 of the transition fitting 18. The flanges 21 have a plurality of vertically aligned apertures therein for selective registration with aligned apertures in the lower portion of the tubular support post 20 so as to provide for incremental vertical adjustment thereto with removable fasteners 23 interlocking same to one another at the desired height adjustment as will be well known to those skilled in the art.

Figure 2:
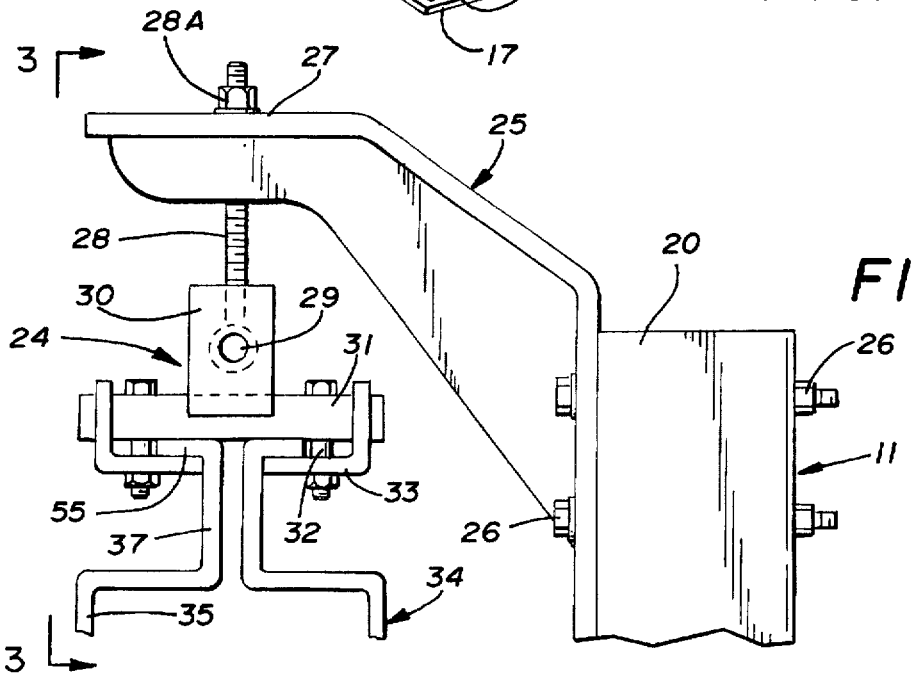
FIG. 2 is an enlarged elevated view of an attachment point between the guide and support rails and a lift beam suspended therefrom.
Figure 3:
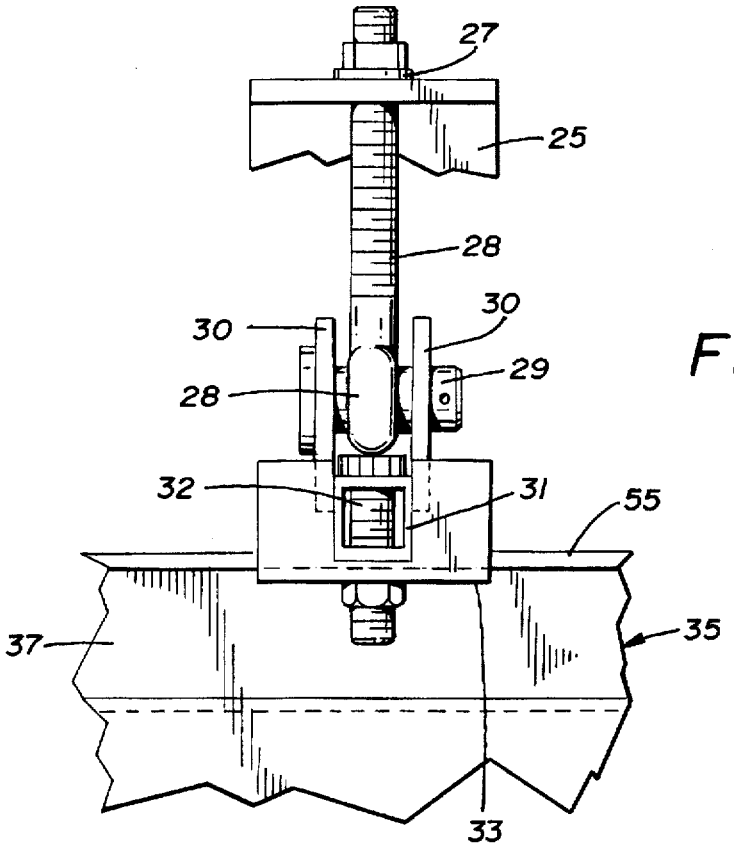
FIG. 3 is an end view on lines 3—3 of FIG. 2.

Referring to FIGS. 1, 2, 3, and 12 of the drawings, a rail support bracket 24 and support arm 25 can be seen wherein the support arm 25 extends from and is secured to the free end of a tubular post portion 20 by fasteners 26. The support arm 25 is apertured in its outermost portion 27 to accept a threaded eye-bolt 28 and locking nut 28A of the rail support bracket 24 therethrough as best seen in FIGS. 2 and 3 of the drawings. A removable pin 29 extends through the eye-bolt 28 on a pair of apertured aligned lugs 30 extending from an apertured tubular element 31 from which is secured by respective fasteners 32 a pair of rail engagement flanges 33.

The guide and support rails 12 are best seen in FIGS. 1, 2, 3, and 4 of the drawings are formed from modular elements, each of which is defined by combining a pair of identical rail sections 34 to one another. Each rail section 34 is an elongated compound angular stamped configuration, best seen in FIG. 4 of the drawings having a generally flat sidewall portion 35 with right angularly flanged upper edge portion 36 with a second right angular flange portion 37 extending therefrom with a return flange 38 defining one-half of a dual channel 39.

A lower portion 40 of the sidewall 35 is tapered inwardly to an inturned right angular flange 41 parallel with the first right angular flange upper edge portion 36 hereinbefore disclosed.

A second upstanding right angular flange 42 extends from the flange 41 which defines one-half of the trolley support and guide track 43. A pair of apertured lugs 44 extend respectively from the sidewall 35 and tapered lower portion 40 respectively on oppositely disposed rail section ends as to be in abutting relation with one another during rail assembly as will be described hereinafter.

Figure 4:
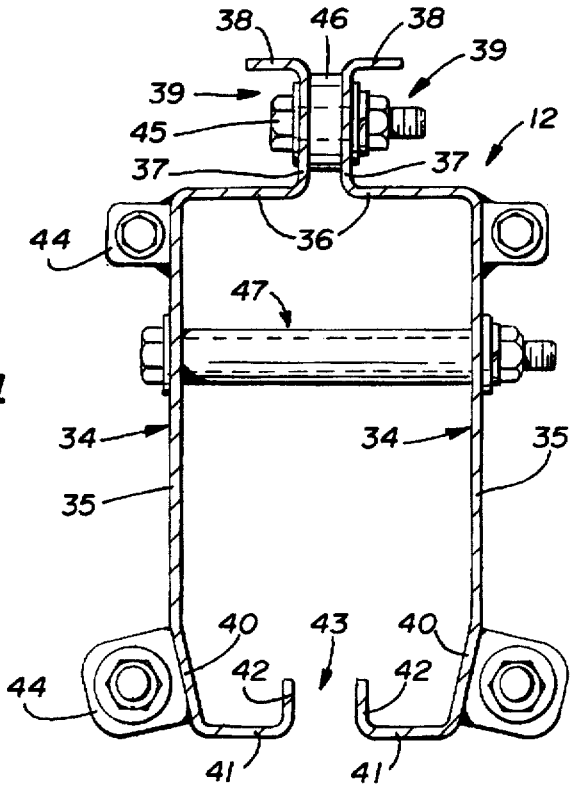
FIG. 4 is an enlarged cross-sectional view of a typical modular rail section on lines 4—4 of FIG. 1.

Referring specifically to FIG. 4 of the drawings, the assembled guide and support rail 12 can be seen formed of the two identical rail sections 34. Each of the rail sections 34 has a plurality of apertures in its respective flange portion 37 which is positioned a fastener 45 with a spacer 46 therein. A second series of apertures are formed in the sidewall portion 35 through which extends fastener and spacer assemblies 47 as will be well understood by those skilled in the art thus defining an assembled modular rail element.

Referring now to FIGS. 1, 9, 10, and 11 of the drawings, the lift beam 13 can be seen formed by a pair of the interconnected rail sections 34 with respective end cap fittings 49 on each end thereof. The end cap fitting 49 is formed of a portion of rail section 34 with an extended end plate 50 having a pair of upstanding apertured lugs 51 extending therefrom. The end cap fitting 49 has an offset longitudinally staggered construction wherein the rail section portions 52 and 53 are of different longitudinal lengths defining the staggered configuration that imparts greater rigidity to horizontal lug mounting surfaces on the end cap fittings attached to respective staggered rail section ends at 54 and 55. The end cap 49 is secured to the staggered end rail sections 54 and 55 by respective multiple fasteners 49A through aligned apertures in the respective rail sections flanged portion 37 and aligned apertured lugs 44 thereon as hereinbefore described and best seen in FIGS. 10 and 11 of the drawings.

Figure 6:
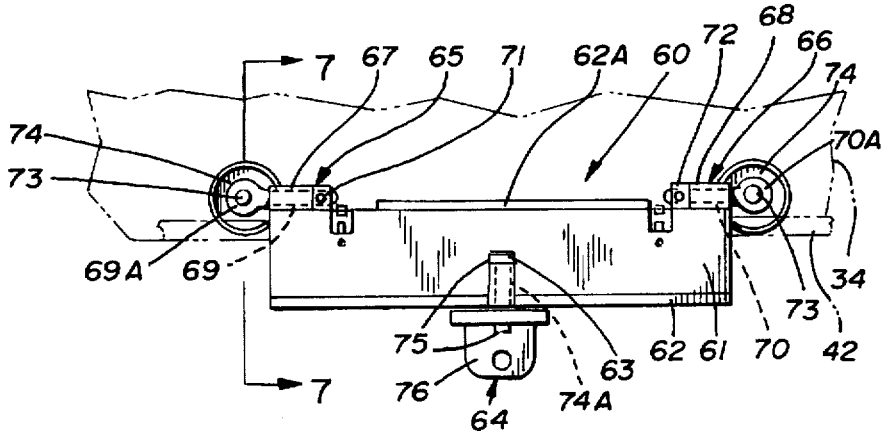
FIG. 6 is an enlarged elevated view of a support trolley within a modular rail section shown in broken lines for orientation purposes.
Figure 7:
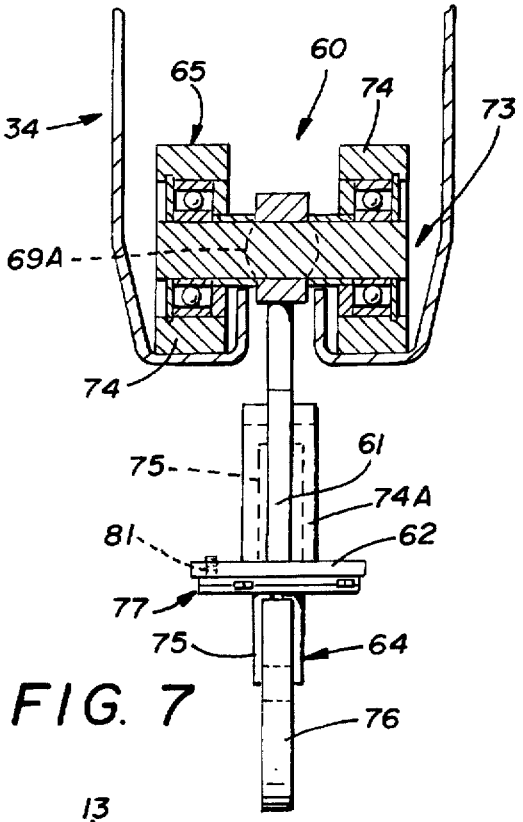
FIG. 7 is an enlarged partial cross-sectional view of the trolley on lines 7—7 of FIG. 6 of the drawings.
Figure 9:
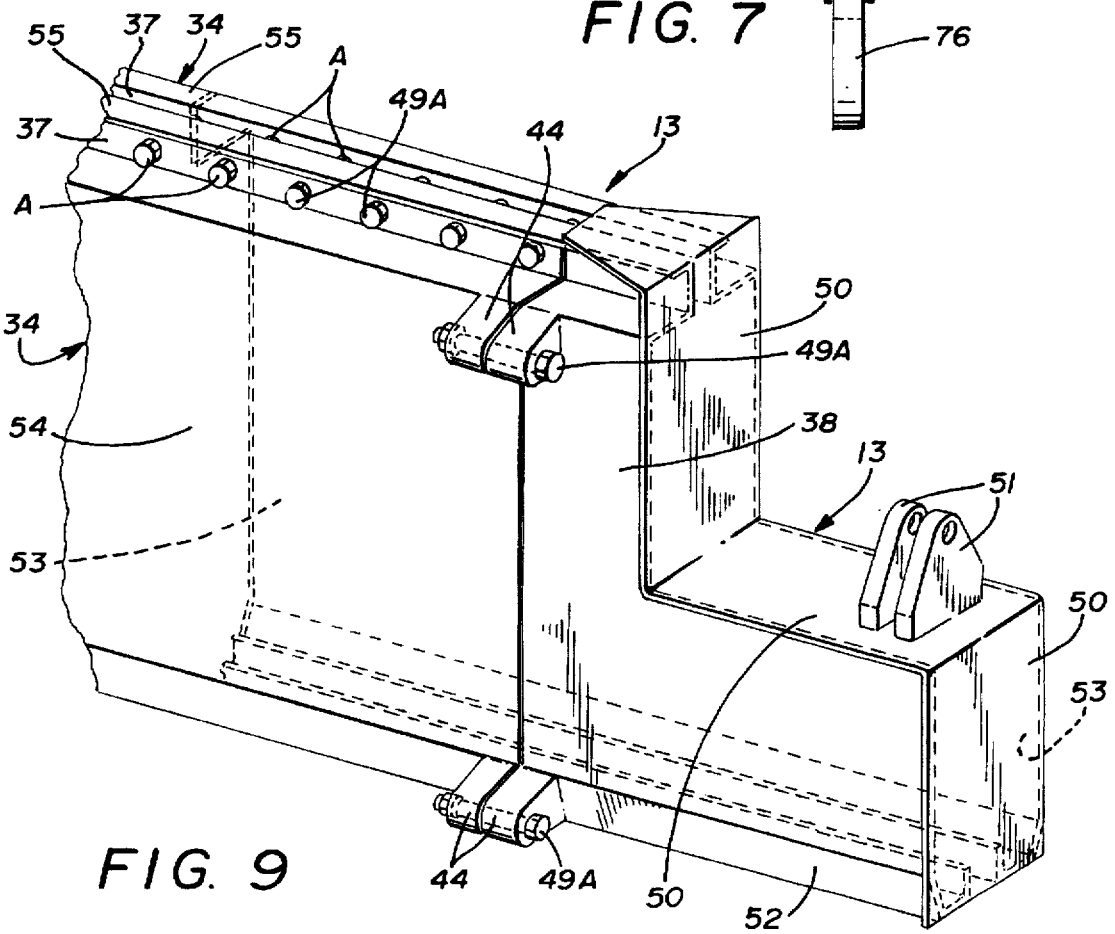
FIG. 9 is an enlarged perspective view of an end portion of the lift beam of the invention.
Figure 10:
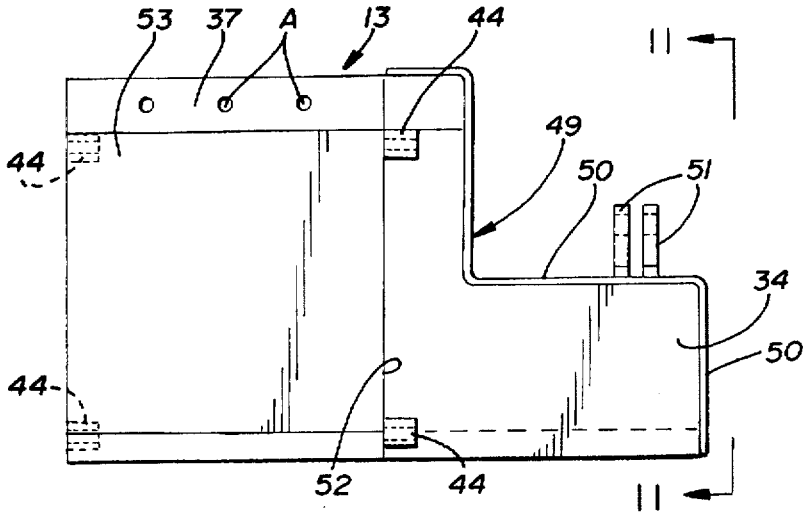
FIG. 10 is a side elevational view of the lift beam portion shown in FIG. 9.
Figure 11:
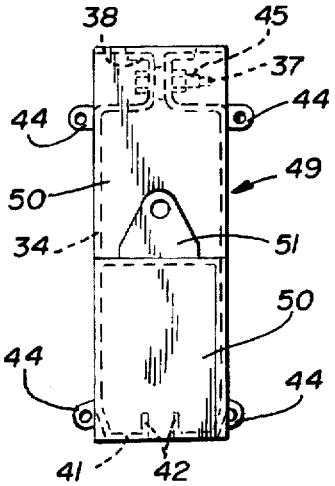
FIG. 11 is an end view of the lift beam portion on lines 11—11 of FIG. 10.

Referring now to FIGS. 6 and 7 of the drawings, a wheeled lift beam support trolley 60 can be seen that is positioned within the respective rail sections 34 and from which the lift beam 13 is suspended. The support trolley 60 has a generally rectangular main support frame member 61 with a bottom flange 62 and top flange 62A extending outwardly therefrom as best seen in FIG. 7 of the drawings.

A notch is formed midway within the main support frame member 61 at 63 having a pivoted lift rail support assembly 64 extending therefrom. A pair of flexible identical wheel assemblies 65 and 66 extend from oppositely disposed support sleeves 67 and 68 secured to said main frame member 61 respectively. Tie rods 69 and 70 are rotatably positioned within said respective sleeves 67 and 68 by retaining sleeve and pin assembly 71 and 72 engaging through apertures in the tie rod free ends as best seen in FIG. 6 of the drawings. Each of the tie rods 69 and 70 have an apertured axle support lug portion 69A and 70A on their respective ends. Axle and bearing assemblies 73 are mounted within the respective support lugs. Each of said axle and bearing assemblies 73 have a pair of trolley support wheels 74 rotatably positioned thereon as will be well understood by those skilled in the art. The hereinbefore disclosed flexible wheel assemblies 65 and 66 support the trolley 60 within the rail sections 34 in spaced relation thereto. The rotatable tie rods 69 and 70 allow the wheel and axle assembly 74 to rotate on the longitudinal axis within the rail track 43.

Figure 8:
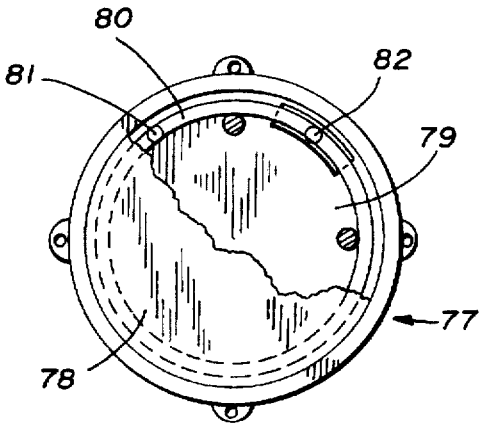
FIG. 8 is a top plan view with portions broken away of a torsion spring return device.

Referring now to FIGS. 7 and 8 of the drawings, the pivot lift beam support assembly 64 can be seen having a support sleeve 74A secured within and extending from the notch at 63. A pivot pin 75 extends from said sleeve 74A to an apertured lift beam support bracket 76. The lift rail support bracket 76 is spring-urged about its pivot pin by a return assembly 77, best seen in FIG. 8 of the drawings. The return assembly 77 has an upper and lower housing sections 78 and 79 which enclose a spring element 80. The respective housing sections 78 and 79 are arcuately slotted for outstanding oppositely disposed spring engagement pins 81 and 82 extending therefrom. The spring engagement pins 81 and 82 are respectively engaged to the flange 62 and the lift rail support bracket 64 imparting spring tension therebetween as will be well understood by those skilled in the art.

In operation, the adjustable support posts 11 are secured to the support plates 17 secured to the floor FL. The support posts 17 are vertically adjusted by the telescopically extensible post extensions 20. After alignment and spacing of the posts are confirmed, the assembled rail sections 34 are interconnected to one another by the abutting lugs 44 with fasteners and hung from the support arms 25 by the rail support brackets 24, best seen in FIGS. 2 and 3 of the drawings. With the trolley assembly 60 positioned within the respective rail sections 34 the lift beam 13 can be supported therefrom by the pivoted lift beam support bracket 64 as hereinbefore described.

Figure 5:
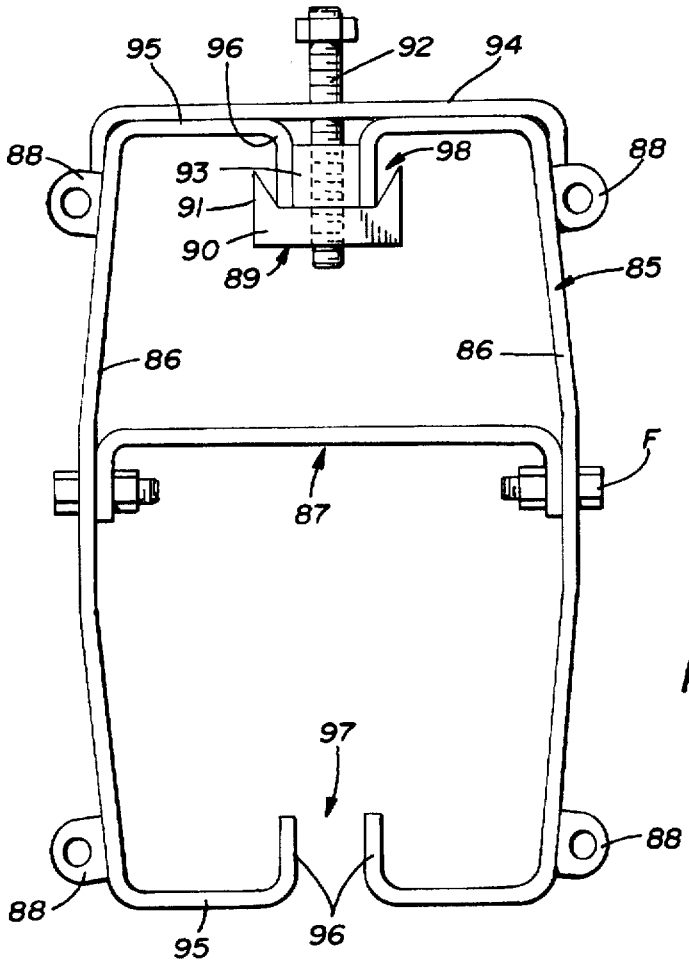
FIG. 5 is an enlarged cross-sectional view of an alternate rail modular construction with alternate support attachment and integral rail reinforcement methods.

Referring now to FIG. 5 of the drawings, an alternate form of the rail section can be seen at 85 comprised of a pair of rail portions 86 interconnected to one another by multiple fasteners and bracket assemblies 87 midway therealong. The alternate rail sections 86 are secured to one another in end to end relationship by abutting apertured lugs 88 extending therefrom in the same manner as the hereinbefore described rail sections 34 and alternate support bracket 80 is required to support same and it is directly engageable within the upper portion of the rail section 86. The support bracket assembly 89 has an apertured bracket engagement base fitting 90 with upstanding oppositely disposed tapered rail engagement portions 91. A threaded support rod 92 is threadably secured through the base fitting 90 with an apertured spacer 93 positioned thereon. An apertured alignment bracket 94 is positioned over the assembled alternate rail sections 85 through which the support rod 92 extends for engagement with a supporting structure as previously described.

The rail portions 86 have identical pairs of inturned right angular flanges 95 and 96 with together with opposing portions define a rail track 97 and the mounting apertured area 98 as hereinbefore described.

It will thus be seen that a new and useful modular lift rail assembly has been illustrated and described and it will be apparent to those skilled in the art that various changes and modifications may be made thereto without departing from the spirit of the invention.

Therefore I claim:

1. A lifting rail apparatus for lifting and transporting a work piece comprises, a plurality of adjustable ground engaging support members, modular rails secured to said ground engagement support members, a trolley assembly within said modular rails, said trolley assembly comprises, a trolley support frame, a pair of flexible wheel assemblies on said support frame, said wheel assemblies comprising a tie rod rotatably positioned on its longitudinal axis within said trolley support frame, an axle and bearing assembly extending from said respective tie rods in 90 degree relation thereto and wheels rotatably positioned thereon in oppositely disposed relation to one another, a lift beam movable laterally along said rails, said modular rails and said lift beam comprised of pairs of identical interconnected rail sections defining a trolley guide track therebetween, said rail sections being longitudinally staggered from one another, for overlapping end to end engagement with adjacent rail sections, rail support brackets removably securing said modular rails to said support members in pivoted spaced parallel relation thereto, said rail support brackets comprising, a threaded support element, a pin removably extending through said support element, apertured aligned lugs extending from a support tube, and oppositely disposed rail engagement flanges on said tube.

2. The lifting rail apparatus of claim 1 wherein said support members are vertically and axially adjustable.

3. The lifting rail apparatus as set forth in claim 1 wherein said interconnected rail sections defining said lift beam have end registerable end cap fittings thereon.

4. The lifting rail apparatus set forth as in claim 1 wherein said lifting beam is resiliently secured to said trolley assembly by a spring return assembly.

5. The lifting rail apparatus set forth in claim 1 wherein said means for pivotally securing said lift beam to said trolley support frame comprises, a pin and sleeve assembly extending from said support frame.

6. The lifting rail apparatus as set forth in claim 1 further comprising modular rail support arms extending from said ground engaging support members.

* * * * *